US005924739A

United States Patent [19]

Garbutt

[11] Patent Number: 5,924,739

[45] Date of Patent: Jul. 20, 1999

[54] BOTTLE CAPSULE INFORMATION PANEL

[76] Inventor: Bryan Eugene Garbutt, P.O. Box 595613, Dallas, Tex. 75359

[21] Appl. No.: 08/840,102

[22] Filed: Apr. 11, 1997

[51] Int. Cl.[6] ..... G09F 3/04; G09F 3/00

[52] U.S. Cl. ..... 283/81; 156/DIG. 13; 156/DIG. 14; 283/900; 283/67; 283/70; 40/310; 40/630

[58] Field of Search ..... 156/DIG. 13, DIG. 14; 283/900, 81, 67, 70; 40/310, 630

[56] References Cited

U.S. PATENT DOCUMENTS

| | | | |
|---|---|---|---|
| 2,123,610 | 12/1938 | Neher | 40/310 |
| 4,000,824 | 1/1977 | Han | 215/232 |
| 4,004,705 | 1/1977 | Fujio | 40/310 |
| 4,066,180 | 1/1978 | Sanchez | 215/254 |
| 4,506,797 | 3/1985 | Bullock, III | 215/256 |
| 4,768,667 | 9/1988 | Magnusson | 215/255 |
| 5,380,045 | 1/1995 | Comann | 283/70 |
| 5,489,456 | 2/1996 | Instance | 428/40 |

*Primary Examiner*—Willmon Fridie, Jr.
*Assistant Examiner*—Mark T. Henderson
*Attorney, Agent, or Firm*—Smith & Danamraj, P.C.

[57] ABSTRACT

A device and method of placing an information panel on the inside of a bottle capsule. The device comprises a capsule circumferentially surrounding the neck of a wine bottle. The inner side of the capsule has an information panel. The information panel contains a message or code to the user of the product. Additionally, a tear-away tab is located on the capsule for easy removal of the capsule from the bottle. The method begins by printing product information on an information panel. Next, the information panel is affixed to an inner side of a removable capsule. The removable capsule is placed circumferentially around a container. Next, the capsule is removed from the bottle by pulling on a tear-away tab located on the capsule.

18 Claims, 2 Drawing Sheets

BOTTLE CAPSULE INFORMATION PANEL

BACKGROUND OF THE INVENTION

1. Technical Field of the Invention

This invention relates to product information panels, and, more particularly, to printed information located on an inside portion of bottle capsules.

2. Description of Related Art

There are many occasions when a manufacturer of a bottled product wants to convey information to its customers. The manufacturer may want the information to be conveyed in a way which is convenient for the customer to carry, yet does not detract from the aesthetic appearance of the product. For example, when a customer in a restaurant enjoys a bottle of wine, he may wish to remember the wine for future reference. Most customers would not want to carry the empty bottle back home, and it is inconvenient to have to write down such information as the name of the wine, the winery, the vintage, etc. Quite often, the customer forgets the relevant information. Additionally, a manufacturer may wish to identify a wholesaler who carries the wine to a retailer or restauranteur. Wholesalers may also identify the source producer, importer, or marketing agent of a particular wine. A method or device is needed which can conveniently convey the product information to the customer.

Although there are no known prior art teachings of a solution to the aforementioned deficiency and shortcoming such as that disclosed herein, prior art references that discusses subject matter that bears some relation to matters discussed herein are U.S. Pat. No. 4,506,797 to Bullock, III (Bullock), U.S. Pat. No. 5,380,045 to Comann, and U.S. Pat. No. 5,489,456 to Instance.

Bullock discloses a plastic cover which fits over the top and partially down the sides of a corked wine bottle to prevent removal of the cork without providing an indication of tampering. The cover has a cap bead and a skirt. A tear strip is formed circumferentially around the cap bead. By tearing off the tear strip, the cap bead can be removed. However, Bullock does not teach or suggest a method or structure of providing printed information panels on a bottle. Bullock merely discloses a protective covering for a wine bottle.

Comann discloses a removable label for a wine bottle which allows a consumer to easily remember the source, name and year of the wine. The label is attached to the wine bottle with reusable glue, Velcro, or other means. The removable label may also be a portion of the regular label. But Comann has several inherent disadvantages. First, the information label is located on the main body of the wine bottle. If the bottle is placed in a bucket of ice and water, as in a restaurant, the label becomes soggy and possibly unusable. Additionally, since wine bottles are often exposed to damp conditions in cellars, or wet conditions due to condensation or being placed in wine buckets, many wine producers attach wine bottle labels using a very strong glue. This makes it difficult or impossible for a consumer to remove the label from the bottle. Finally, since the removable label is attached to the main label of the wine bottle, it detracts from the aesthetic appearance of the bottle.

Instance discloses a self-adhesive label in the form of a tag for attachment to the neck of a bottle. The backing is stuck to the bottle, and tear-off labels with product information are attached to the backing. Although Instance shows the basic concept of a removable label for a wine bottle, Instance has several disadvantages. Since the label is attached to the wine bottle with glue in the same area as the regular label, if the bottle is place in a bucket of ice, the label may become soggy and unusable. Additionally, the label detracts from the aesthetic appearance of the bottle.

An information panel is needed that provides product information to a consumer of a specific container which is easily removable, does not detract from the aesthetic appearance of the container, and can withstand being placed in a bucket of ice or water. It is an object of the present invention to provide such a device.

SUMMARY OF THE INVENTION

Many wine makers now complete the bottling of their wines by placing a plastic or metal foil "capsule" around the neck of the bottle. The capsule may partially or totally cover the top of the bottle and the cork. In one aspect, the present invention is a capsule having perforations and a tab for easy removal. An information panel is printed on the inside of the removable capsule.

In another aspect, the present invention is a capsule attached to a container for providing information to a user of the container. The capsule comprises a sheath circumferentially surrounding the container. An informational panel is located on an inner side of the sheath. Additionally, the sheath has means for removing the sheath from the container.

In another aspect, the present invention is a method of conveying product information about a product in a container to a user of the product. The method begins by printing the product information on an information panel. Next, the information panel is affixed to an inner side of a removable capsule. The removable capsule is then placed circumferentially around the container. Next, the removable capsule is removed from the container.

In still another aspect, the present invention is a method of conveying product information about wine in a bottle to a consumer. The method begins with printing the product information on an inner side of a removable bottle capsule. Next, the removable bottle capsule is placed around the neck of the bottle, enabling the consumer to remove the removable bottle capsule to obtain the product information.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

The present invention is a device and method of placing printed information on the inside of a bottle capsule.

Figure 1:
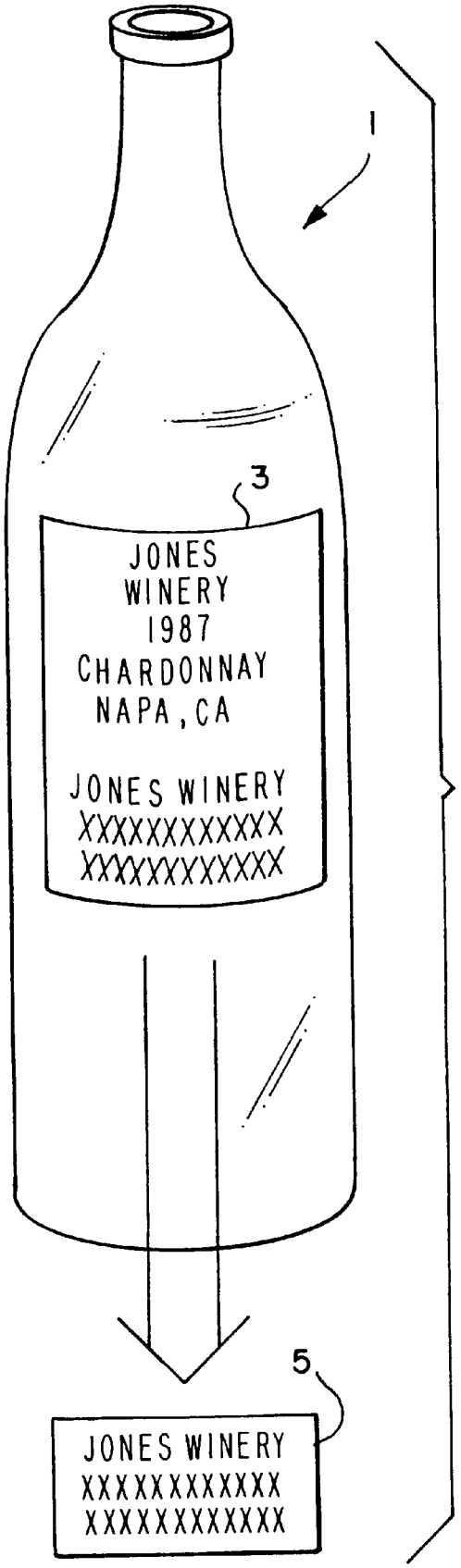
FIG. 1 (PRIOR ART)
FIG. 1 (Prior Art) is an illustration of an existing method of providing a removable label for a wine bottle.

FIG. 1 is an illustration of an existing method of providing a removable label for a wine bottle. The system includes a wine bottle 1, a main wine bottle label 3, and a detachable label 5. The main wine bottle label 3 is typically attached to the wine bottle 1 by glue. The detachable label 5 is attached to the main wine bottle label 3. The detachable label 5 can either be affixed to the wine bottle 1 by glue or remain attached to the main wine bottle label 3 only. Detachable label 5 contains information to identify the particular bottle of wine to which the label was originally attached.

When a consumer wants to remember a particular wine, he removes the detachable label 5 from the main wine bottle label 3. The consumer then keeps the detachable label 5 having the wine data for future reference.

However, there are several disadvantages to using these detachable labels. First, since the detachable label 5 is attached to the main wine bottle label 3 on the body of the wine bottle 1, the detachable label 5 is susceptible to the adverse effects of ice or water. When a wine bottle is placed in a bucket of ice or water, the detachable label is exposed to the ice or water. The detachable label 5 becomes soggy, soiled, or may detach from the bottle and be lost. Additionally, since the detachable label 5 is located on the main wine bottle label 3, the detachable label 5 is prominently displayed. In many instances, the aesthetic appearance of the bottle is adversely affected. In addition, if the detachable label 5 is attached to the wine bottle 1 with glue, the detachable label 5 may be difficult to remove. If the glue is of a nature allowing easy removal of the detachable label 5, the glue may not hold sufficiently if exposed to water.

Figure 2:
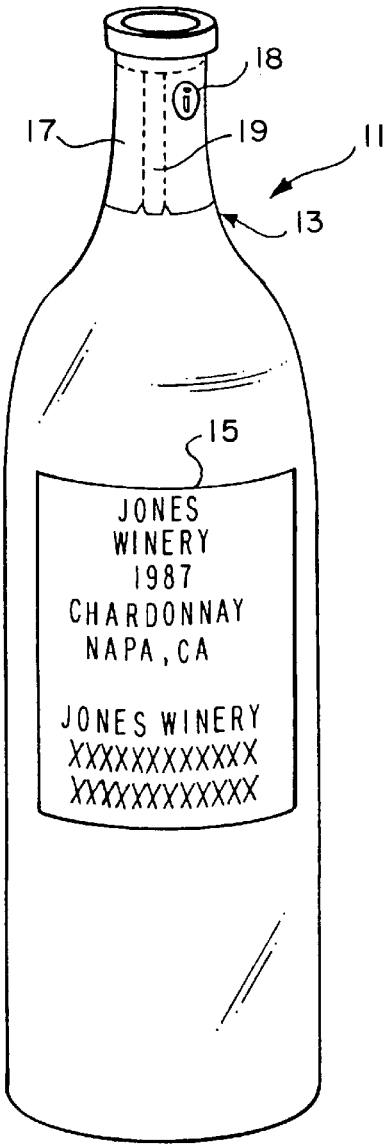
FIG. 2 is an illustration of a bottle having an information panel printed on the inside of a capsule from the bottle in the preferred embodiment of the present invention.

FIG. 2 is an illustration of a bottle having an information panel printed on the inside of a capsule from the bottle in the preferred embodiment of the present invention. The invention includes a bottle 11 having a neck 13, a label 15, a bottle capsule 17, and a tear-away tab 19.

The label 15 remains permanently affixed to the bottle 11. The bottle capsule 17 surrounds the bottle 11 at the neck 13 forming a sheath around the neck 13. The capsule 17 may be larger than existing capsules (i.e., it may extend further down the neck of the bottle), in order to increase the area for printed information on the inside surface of the capsule. In the preferred embodiment of the present invention, the bottle capsule 17 is made of plastic or another water-proof material such as metal foil. Additionally, the bottle capsule 17 is made of a material which does not detract from the aesthetic appearance of the bottle. For example, the bottle capsule 17 may be clear, or of a color to coordinate with the rest of the wine bottle 11 and the color scheme of the label 15. However, in alternate embodiments, the bottle capsule 17 may be made from a variety of materials such as metal foil or rubber.

The capsule fits tightly around the neck of the bottle, but is not glued to the bottle. Typically, as is well known in the art, the capsule is heat-shrunk around the neck of the bottle. In addition, a symbol or other indication 18 may be placed on the outside of the bottle capsule 17 indicating there is an information panel underneath. The bottle capsule 17 is equipped with perforations forming a tear-away tab 19 for easy removal of the bottle capsule 17 from the wine bottle 11. In alternate embodiments of the present invention, any means providing for easy removal of the bottle capsule 17 may be used, such as flex-ties.

Figure 4:
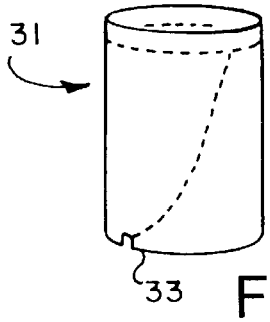
FIG. 4 is an illustration of a bottle capsule with a tear-away tab enabling easy removal of the bottle capsule in a second embodiment of the present invention.
Figure 5:
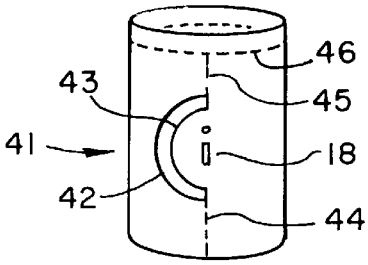
FIG. 5 is an illustration of a bottle capsule with a tear-away tab enabling easy removal of the bottle capsule in a third embodiment of the present invention.
Figure 3:
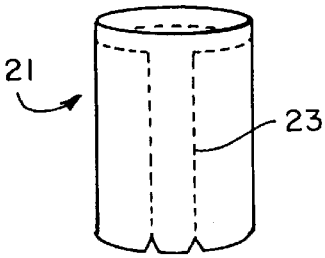
FIG. 3 is an illustration of a bottle capsule with a tear-away tab enabling easy removal of the bottle capsule according to a first embodiment of the present invention.

FIGS. 3, 4, and 5 are illustrations of bottle capsules having different embodiments of tear-away tabs enabling easy removal of the bottle capsules. In FIG. 3, a bottle capsule 21 is equipped with a tab 23. Tab 23 is formed by tear-away perforation lines running vertically from the bottom of the bottle capsule 21 to the top of the bottle capsule 21. At the top of the bottle capsule 21, the perforation lines split and continue to run circumferentially around the entire bottle capsule 21. By pulling up on tab 23, the bottle capsule 21 may be easily removed.

In FIG. 4, a bottle capsule 31 is equipped with a tab 33. The tab 33 attaches to a tear-away perforation line running diagonally around the circumference of the bottle capsule 31. By pulling upward diagonally on the bottom of tab 33, the bottle capsule 31 is easily removed from a bottle.

In FIG. 5, a bottle capsule 41 is die cut in an arch 42 to form a tab 43. The bottle capsule 41 is cut away in the area of the arch 42 to expose the glass of the bottle. The tab 43, therefore, lies flat against the neck of the bottle. A vertical tear-away perforation line 44 extends from the bottom of the arch 42 to the bottom of the capsule 41. A second vertical tear-away perforation line 45 extends from the top of the arch 42 to a horizontal tear-away perforation line 46 which runs circumferentially around the bottle capsule 41. By lifting and pulling tab 43, the bottle capsule 41 can be easily removed. Also shown in FIG. 5 is an example of the symbol or other indication 18 (FIG. 2) which may be placed on the outside of the bottle capsule 41 indicating there is an information panel underneath.

Figure 7:
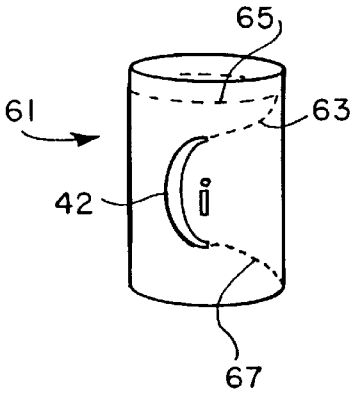
FIG. 7 is an illustration of a bottle capsule with a tear-away tab enabling easy removal of the bottle capsule in a fourth embodiment of the present invention.
Figure 6:
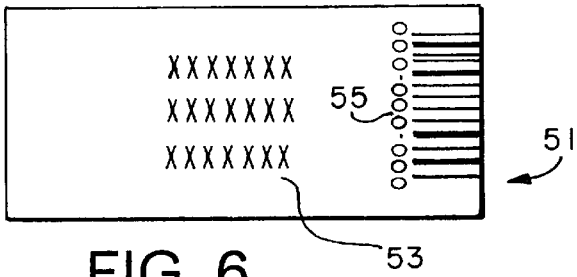
FIG. 6 is an illustration of the inner side of a bottle capsule removed from a bottle according to the teachings of the present invention.

FIG. 6 is an illustration of a bottle capsule 51 removed from a bottle in the preferred embodiment of the present invention. When the bottle capsule 51 is laid flat, the inside of the bottle capsule 51 displays an information panel 53. The information panel 53 contains printed information which may be printed directly upon the inside of the bottle capsule 51. In addition, the information panel 53 may be a separate label which is affixed to the bottle capsule 51. The panel 53 is printed with water-proof ink, and may include various types of information. For example, the panel 53 may indicate product information such as the type of wine, the vineyard, the vintage year of the wine, the brand name, or a miniature reproduction of the wine bottle label. A telephone number may be included for the consumer to call for more information. In addition, to locate a local retailer who carries the wine, the E-mail address or mailing address of the winery may be included. Additional information such as famous quotes, contest prizes, or even the health benefits of wine may also be included. Additionally, the information panel 53 may contain a code, such as an Universal Purchase Code (UPC) 55, having additional machine-readable information. Since the information panel 53 is printed on the inside of the bottle capsule 51, it is not visible until the capsule is removed. Therefore, the aesthetic appearance of the bottle is preserved. FIG. 7 is an illustration of a bottle capsule 61 with a tear-away tab enabling easy removal of the bottle capsule in a fourth embodiment of the present invention. The bottle capsule 61 is similar to the bottle capsule 41 illustrated in FIG. 5. However, in the embodiment illustrated in FIG. 7, bottle capsule 61 includes a diagonal tear-away perforation line 63 extending from the top of the arch 42 to a horizontal tear-away perforation line 65 which runs circumferentially around a top portion of the bottle capsule 61. Additional, a diagonal tear-away perforation line 67 extends from the bottom of the arch 42 to the bottom of the bottle capsule 61.

At the request of a consumer, a retailer may use the UPC code 55 to quickly ascertain whether a wine is in stock in his store or another store within the same retail or grocery chain. Additionally, a retailer or restauranteur may use the information panel 53 and the UPC code to identify a local wholesaler who carries the wine. Wholesalers, furthermore, may use the UPC code or other information on the panel to identify the source producer, the importer, or the United States marketing agent or broker of a particular wine. Thus, a wine producer may utilize the information panel 53 to convey useful information to all participants in the producer's wine distribution channels—marketing agents/brokers, importers, wholesale distributors of wine, restauranteurs, retailers, and consumers—thus increasing product awareness and sales opportunities.

Although a bottle capsule is ideal for wine bottles, an information panel attached or printed to a capsule may be used on any circular container. For example, the capsule may be used on food items such as ketchup, salad dressing, or sodas. For food items, the bottle capsule may be made of plastic, water-proof material such as metal foil, or treated or coated paper.

It is thus believed that the operation and construction of the present invention will be apparent from the foregoing description. While the invention shown and described has been characterized as being preferred, it will be readily apparent that various changes and modifications could be made therein without departing from the spirit and scope of the invention as defined in the following claims.

What is claimed is:

1. A capsule attached to a container for providing information to a user of said container, comprising:

a single layered, non-overlapping sheath, said sheath having a first end attached by a bonding means to a second end circumferentially surrounding and adhering to said container;

printed information located on an inner side of said sheath; and at least one perforation line for removing said sheath from said container, said perforation line positioned between the first end and the second end of the sheath.

2. The capsule of claim 1, wherein said container is a bottle.

3. The capsule of claim 2, wherein said bottle is a wine bottle.

4. The capsule of claim 3, wherein said printed information includes information identifying a unique wine in said wine bottle.

5. The capsule of claim 1, wherein said sheath is composed of plastic.

6. The capsule of claim 1, wherein said at least one perforation line includes perforations running vertically from a bottom of the sheath to a top of the sheath.

7. The capsule of claim 6, wherein said at least one perforation line includes a tear-away tab located adjacent to the perforations.

8. The capsule of claim 1, wherein said at least one perforation line includes:

a tear-away tab attached to said sheath adjacent to said perforation line; and perforations running diagonally from a bottom of said sheath to a top of said sheath.

9. The capsule of claim 1, wherein said printed information includes unique product identifying information for said user about a product in said container.

10. The capsule of claim 9, wherein said printed information includes a code containing information on said container.

11. The capsule of claim 10, wherein said code is a machine-readable code.

12. The capsule of claim 1, wherein said sheath is composed of rubber.

13. The capsule of claim 1, wherein said sheath is composed of metal foil.

14. The capsule of claim 1, further comprising a symbolic indication on an outer side of said sheath that informs the user that information is printed on the inner side of the capsule.

15. A capsule attached to a container for providing information to a user of said container comprising:

a heat shrunk sheath circumferentially surrounding and adhering to said container;

printed information located on an inner side of said sheath;

and means for removing said sheath from said container, said means for removing said sheath including:

a tear-away tab attached to the sheath;

a first set of perforations running diagonally from a bottom portion of the tear-away tab to a bottom of the sheath; and a second set of perforations running diagonally from a top portion of the tear-away tab to a top of the sheath.

16. The capsule of claim 4, wherein said printed information includes:

an appellation of the wine;

a producer of the wine; and a grape variety of the wine.

17. The capsule of claim 1, wherein the sheath is opened at a top portion of the container.

18. The capsule of claim 1, wherein the sheath encompasses a top portion of the container.

* * * * *